US005545262A

United States Patent [19]

Hardee et al.

[11] Patent Number: 5,545,262

[45] Date of Patent: Aug. 13, 1996

[54] METHOD OF PREPARING A METAL SUBSTRATE OF IMPROVED SURFACE MORPHOLOGY

[75] Inventors: Kenneth L. Hardee, Middlefield; Lynne M. Ernes, Willoughby; Richard C. Carlson, Euclid, all of Ohio; David E. Thomas, Northbridge, Mass.

[73] Assignee: ELTECH Systems Corporation, Chardon, Ohio

[21] Appl. No.: 341,981

[22] Filed: Nov. 16, 1994

Related U.S. Application Data

[62] Division of Ser. No. 132,975, Oct. 7, 1993, Pat. No. 5,366,598, which is a continuation of Ser. No. 686,963, Apr. 18, 1991, Pat. No. 5,262,040, which is a continuation-in-part of Ser. No. 374,429, Jun. 30, 1989, abandoned.

[51] Int. Cl.[6] ..... C21D 1/26; C22F 1/02

[52] U.S. Cl. ..... 148/527; 29/623.1; 29/DIG. 16; 427/77; 427/226; 427/309; 427/318

[58] Field of Search ..... 156/664; 29/623.1, 29/DIG. 16, DIG. 45; 148/669, DIG. 3, DIG. 51, 527; 427/77, 226, 309, 318

[56] References Cited

U.S. PATENT DOCUMENTS

| | | | |
|---|---|---|---|
| Re. 28,820 | 5/1976 | Beer | 427/126 |
| 3,265,526 | 8/1966 | Beer | 117/50 |
| 3,573,100 | 3/1971 | Beer | 134/3 |
| 3,632,498 | 1/1972 | Beer | 204/290 |
| 3,650,861 | 3/1972 | Angell | 156/18 |
| 3,684,543 | 8/1972 | de Nora et al. | 117/2 |
| 3,706,600 | 12/1972 | Pumphrey et al. | 134/3 |
| 3,711,385 | 1/1973 | Beer | 204/59 |
| 3,778,307 | 12/1973 | Beer | 117/221 |
| 3,864,163 | 2/1975 | Beer | 117/217 |
| 3,878,083 | 4/1975 | de Nora et al. | 204/290 |
| 3,948,736 | 4/1976 | Russell | 204/15 |
| 4,067,734 | 1/1978 | Curtis et al. | 148/421 |
| 4,068,025 | 1/1978 | Sahm | 427/309 |
| 4,208,450 | 1/1980 | Lewis et al. | 427/126.3 |
| 4,446,245 | 5/1984 | Hinden | 502/101 |
| 4,528,084 | 7/1985 | Beer | 204/290 F |
| 4,572,770 | 2/1986 | Beaver et al. | 204/98 |
| 4,797,182 | 1/1989 | Beer | 204/14.1 |

OTHER PUBLICATIONS

Titanium Electrode for the Manufacture of Electrolytic Manganese Dioxide by K. Shimizu, pp. 233–236 (1970) no month available.

Titanium as a Substrate for Electrodes, by P C S Hayfield, Research & Dev. Department, IMI plc, Kynoch Works, Witton Birmingham B6 7BA England, pp. 1–11, Figures 1–13 no date available.

*Primary Examiner*—Kathryn Gorgos

*Attorney, Agent, or Firm*—John J. Freer; David J. Skrabec

[57] ABSTRACT

A metal surface is now described having enhanced adhesion of subsequently applied coatings. The substrate metal of the article, such as a valve metal as represented by titanium, is provided with a highly desirable surface characteristic for subsequent coating application. This can be initiated by selection of a metal of desirable metallurgy and heat history, including prior heat treatment to provide surface grain boundaries which may be most readily etched. In subsequent etching operation, the surface is made to exhibit well defined, three dimensional grains with deep grain boundaries. Subsequently applied coatings, by penetrating into the etched intergranular valleys, are desirably locked onto the metal substrate surface and provide enhanced lifetime even in rugged commercial environments.

7 Claims, No Drawings

METHOD OF PREPARING A METAL SUBSTRATE OF IMPROVED SURFACE MORPHOLOGY

CROSS-REFERENCE TO RELATED APPLICATION

This is a divisional of application Ser. No. 08/132,975, filed Oct. 7, 1993, now U.S. Pat. No. 5,366,598, which is a continuation of U.S. patent application Ser. No. 07/686,963, filed Apr. 18, 1991, now U.S. Pat. No. 5,262,040, which in turn is a continuation-in-part of U.S. patent application Ser. No. 374,429, filed Jun. 30, 1989, now abandoned.

BACKGROUND OF THE INVENTION

The adhesion of coatings applied directly to the surface of a substrate metal is of special concern when the coated metal will be utilized in a rigorous industrial environment. Careful attention is usually paid to surface treatment and pre-treatment operation prior to coating. Achievement particularly of a clean surface is a priority sought in such treatment or pre-treatment operation. Representative of a coating applied directly to a base metal is an electrocatalytic coating, often containing a precious metal from the platinum metal group, and applied directly onto a metal such as a valve metal. Within this technical area of electrocatalytic coatings applied to a base metal, the metal may be simply cleaned to give a very smooth surface. U.S. Pat. No. 4,797,182. Treatment with fluorine compounds may produce a smooth surface. U.S. Pat. No. 3,864,163. Cleaning might include chemical degreasing, electrolytic degreasing or treatment with an oxidizing acid. U.S. Pat. No. 3,864,163.

Cleaning can be followed by mechanical toughening to prepare a surface for coating. U.S. Pat. No. 3,778,307. If the mechanical treatment is sandblasting, such may be followed by etching. U.S. Pat. No. 3,878,083. Or pickling with a non-oxidizing acid can produce a rough surface for coating. U.S. Pat. No. 3,864,163. Such pickling can follow degreasing. U.S. Pat. No. Re. 28,820. The pickling may readily etch titanium to a surface roughness within the range of 150–200 or more microinches. "Titanium as a Substrate for Electrodes", Hayfield, P. C. S., IMI Research and Development Report.

If there is a pre-existing coating present on the substrate metal, the metal can be treated for coating removal. For an electrocatalytic coating, such treatment may be with a melt containing a basic material used in the presence of an oxidant or oxygen. Such can be followed by pickling to reconstitute the original surface for coating. U.S. Pat. No. 3,573,100. Or if a molten alkali metal hydroxide bath is used containing an alkali metal hydride, this is preferably followed by a hot mineral acid treatment. U.S. Pat. No. 3,706,600. It has also been proposed to prepare the surface without stripping the old coating. U.S. Pat. No. 3,684,543. More recently, this procedure has been improved by activation of the old coating, prior to application of the new. U.S. Pat. No. 4,446,245.

Another procedure for anchoring the fresh coating to the substrate, that has found utility in the application of an electrocatalytic coating to a valve metal, is to provide a porous oxide layer which can be formed on the base metal.

It has, however, been found difficult to provide long-lived coated metal articles for serving in the most rugged commercial environments, e.g., oxygen evolving anodes for use in the present-day commercial applications utilized in electrogalvanizing, electrotinning, copper foil plating, aluminum anodizing, sodium sulfate electrolysis, electroforming or electrowinning. Such may be continuous operation. They can involve severe conditions including potential surface damage. It would be most desirable to provide coated metal substrates to serve as electrodes in such operations, exhibiting extended stable operation while preserving excellent coating adhesion. It would also be highly desirable to provide such an electrode not only from fresh metal but also from recoated metal.

SUMMARY OF THE INVENTION

There has now been found a metal surface which provides an excellent, locked on coating of outstanding coating adhesion. The coated metal substrate can have highly desirable extended lifetime even in most rigorous industrial environments. For the electrocatalytic coatings, the invention may provide for lower effective current densities and also achieve substrate metal grains desirably stabilized against passivation.

In one aspect, the invention is directed to a metal article having a surface adapted for enhanced coating adhesion, such surface being free from deleterious affects of abrasive treatment while having desirable surface grain size, which surface has three-dimensional grains with deep grain boundaries, such surface having been etched including the etching of impurities located in the grain boundaries at the surface of the metal, which intergranular etching provides a profilometer-measured average surface roughness of at least about 250 microinches and an average surface peaks per inch of at least about 40, basis a profilometer upper threshold limit of 400 microinches and a profilometer lower threshold limit of 300 microinches.

In another aspect, the invention is directed to the method of preparing a surface of an impure valve metal for enhanced coating adhesion on such surface, which method comprises subjecting the surface to elevated temperature annealing for a time sufficient to provide an at least substantially continuous intergranular network of impurities, including impurities at the surface of such metal; cooling the resulting annealed surface; and etching intergranularly the surface at an elevated temperature and with a strong acid or strong caustic etchant; while maintaining the surface at least substantially free from the deleterious effects of abrasive surface treatment.

In a still further aspect, the invention is directed to a metal article having a surface adapted for enhanced coating adhesion, said surface having, as measured by profilometer, an average roughness of at least about 250 microinches and an average surface peaks per inch of at least about 40, basis the lower and upper threshold limits mentioned hereinbefore. Such surface most desirably also has an average distance between the maximum peak and the maximum valley of at least about 1,000 microinches and an average peak height of at least about 1,000 microinches.

When the fully prepared metals are electrocatalytically coated and used as oxygen evolving electrodes, even under the rigorous commercial operations as mentioned hereinabove, e.g., including continuous electrogalvanizing, electrotinning, electroforming or electrowinning, such electrodes can have highly desirable service life. Also, such metals as electrodes may provide an effectively lower current density, which will aid in prolonging the life of the electrode, when used as above discussed or, for example, in water or brine electrolysis.

DESCRIPTION OF THE PREFERRED EMBODIMENTS

The metals of the substrate are broadly contemplated to be any coatable metal. For the particular application of an electrocatalytic coating, the substrate metals might be such as nickel or manganese, but will most always be valve metals, including titanium, tantalum, aluminum, zirconium and niobium. Of particular interest for its ruggedness, corrosion resistance and availability is titanium. As well as the normally available elemental metals themselves, the suitable metals of the substrate can include metal alloys and intermetallic mixtures. For example, titanium may be alloyed with nickel, cobalt, iron, manganese or copper. More specifically, Grade 5 titanium may include up to 6.75 weight % aluminum and 4.5 weight % vanadium, grade 6 up to 6% aluminum and 3% tin, grade 7 up to 0.25 weight % palladium, grade 10, from 10 to 13 weight % molybdenum plus 4.5 to 7.5 weight % zirconium and so on.

By use of elemental metals, alloys and intermetallic mixtures, it is most particularly meant the metals in their normally available condition, i.e., having minor amounts of impurities. Thus for the metal of particular interest, i.e., titanium, various grades of the metal are available including those in which other constituents may be alloys or alloys plus impurities. In titanium, iron may be a usual impurity. Its maximum concentration can be expected to vary from 0.2 weight percent for grades 1 and 11 up to 0.5% for grades 4 and 6. Additional impurities that may be found throughout the grades of titanium include nitrogen, carbon, hydrogen and oxygen. Since beta-titanium located at the titanium grain boundaries can be susceptible to etching, such beta-titanium is considered herein for purposes of this discussion as an impurity. Thus etching of an impurity as discussed herein may include etching of a phase of the metal itself. In addition to the beta-titanium, the titanium metal of particular interest may have beta-phase stabilizers, some of which may be present in extremely minor amounts in the manner of an impurity and include vanadium, niobium, tantalum, molybdenum, ruthenium, zirconium, tin, hafnium and mixtures thereof. Grades of titanium have been more specifically set forth in the standard specifications for titanium detailed in ASTM B 265-79.

Regardless of the metal selected and how the metal surface is subsequently processed, the substrate metal advantageously is a cleaned surface. This may be obtained by any of the treatments used to achieve a clean metal surface, but with the provision that unless called for to remove an old coating, mechanical cleaning is typically minimized and preferably avoided. Thus the usual cleaning procedures of degreasing, either chemical or electrolytic, or other chemical cleaning operation may be used to advantage.

Where an old coating is present on the metal surface, such needs to be addressed before recoating. It is preferred for best extended performance when the finished article will be used with an electrocatalytic coating, such as use as an oxygen evolving electrode, to remove the old coating. In the technical area of the invention which pertains to electrochemically active coatings on a valve metal, chemical means for coating removal are well known. Thus a melt of essentially basic material, followed by an initial pickling will suitably reconstitute the metal surface, as taught in U.S. Pat. No. 3,573,100. Or a melt of alkali metal hydroxide containing alkali metal hydride, which may be followed by a mineral acid treatment, is useful, as described in U.S. Pat. No. 3,706,600. Usual rinsing and drying steps can also form a portion of these operations.

When a cleaned surface, or prepared and cleaned surface, has been obtained, and particularly where applying an electrocatalytic coating to a valve metal, it is most always contemplated in the practice of the present invention that surface roughness will be achieved by means of etching. In the invention context of etching, it is important to aggressively etch the metal surface to provide deep grain boundaries providing well exposed, three-dimensional grains. It is preferred that such operation will etch impurities located at such grain boundaries. For convenience, a metal having etchable grain boundary impurities may be referred to herein as a metal having a correct "metallurgy" It is however, contemplated that other roughening techniques, which can be used in addition to or along with the roughness achieved by etching, such as plasma spraying of one or more of a valve metal or valve metal oxide, including valve metal suboxides, onto the metal surface can provide the surface roughness characteristics. These characteristics, as measured by profilometer, are more particularly described hereinbelow.

Where etching has been selected to achieve surface roughness, an important aspect of the invention involves the enhancement of impurities of the metal at the grain boundaries. This is advantageously done at an early stage of the overall process of metal preparation. One manner of this enhancement that is contemplated is the inducement at, or introduction to, the grain-boundaries of one or more impurities for the metal. For example, with the particularly representative metal titanium, the impurities of the metal might include iron, nitrogen, carbon, hydrogen, oxygen, and beta-titanium. Although impurities introduction procedures that might be used can include surface deposition, e.g., vapor deposition, which might be followed by a heat treatment for surface impurity diffusion, one particular manner contemplated for impurity enhancement is to subject the titanium metal to a hydrogen-containing treatment. This can be accomplished by exposing the metal to a hydrogen atmosphere at elevated temperature. Or the metal might be subjected to an electrochemical hydrogen treatment, with the metal as a cathode in a suitable electrolyte evolving hydrogen at the cathode.

Another consideration for the aspect of the invention involving etching, which aspect can lead to impurity enhancement at the grain boundaries, involves the heat treatment history of the metal. For example, to prepare a metal such as titanium for etching, it can be most useful to condition the metal, as by annealing, to diffuse impurities to the grain boundaries. Thus, by way of example, proper annealing of grade 1 titanium will enhance the concentration of the iron impurity at grain boundaries. Where the suitable preparation includes annealing, and the metal is grade 1 titanium, the titanium can be annealed at a temperature of at least about 500° C. for a time of at least about 15 minutes. For efficiency of operation, a more elevated annealing temperature, e.g., 600°–800° C. is advantageous. Annealing times at such more elevated temperatures will typically be on the order of 15 minutes to 4 hours. Alternatively, a short, high temperature anneal, e.g., on the order of 800° C. for a few minutes such as 5–10 minutes, may be continued, after rapid or slow cooling, at a quite low temperature, with 200°–400° C. being representative, for several hours, with 10–20 hours being typical. Suitable conditions can include annealing in air, or under vacuum, or with an inert gas such as argon. Subsequent cooling of the annealed metal can appropriately stabilize the grain boundaries for etching. Stabilization may be achieved by controlled or rapid cooling of the metal or by other usual metal cooling technique including quenching. For convenience, a metal having such stabilization may be referred to herein as a metal having a desirable "heat history".

For enhancing coating adhesion for the invention aspect of etching, it can be desirable to combine a metal surface having a correct grain boundary metallurgy as above-discussed, with an advantageous grain size. Again, referring to titanium as exemplary, at least a substantial amount of the grains having grain size number within the range of from about 3 to about 7 is advantageous. Grain size number as referred to herein is in accordance with the designation provided in ASTM E 112-84. Size number for titanium grains below about 3 produce a high percentage of broad grains which detract from advantageous coating adhesion. Grain sizes numbered above about 7 are not desired for best three-dimensional grain structure development. Preferably for titanium, the grains will have size numbers within the range from about 4 to about 6.

After the foregoing operations, e.g., cleaning, or coating removal and cleaning, and including any desired rinsing and drying steps, followed by any impurity enhancement for grain boundary etching, the metal surface is then ready for continuing processing. Where such is etching, it will be with a sufficiently active etch solution to develop aggressive grain boundary attack. Typical etch solutions are acid solutions. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide/hydrogen peroxide, or a melt of potassium hydroxide with potassium nitrate. For efficiency of operation, the etch solution is advantageously a strong, or concentrated, solution, such as an 18–22 weight % solution of hydrochloric acid. Moreover, the solution is advantageously maintained during etching at elevated temperature such as at 80° C. or more for aqueous solutions, and often at or near boiling condition or greater, e.g., under refluxing condition. Following etching, the etched metal surface can then be subjected to rinsing and drying steps to prepare the surface for coating.

Regardless of the technique employed to reach the desired roughness, e.g., plasma spray or intergranular etch, it is necessary that the metal surface have an average roughness (Ra) of at least about 250 microinches and an average number of surface peaks per inch (Nr) of at least about 40. The surface peaks per inch can be typically measured at a lower threshold limit of 300 microinches and an upper threshold limit of 400 microinches. A surface having an average roughness of below about 250 microinches will be undesirably smooth, as will a surface having an average number of surface peaks per inch of below about 40, for providing the needed, substantially enhanced, coating adhesion. Advantageously, the surface will have an average roughness of on the order of about 250 microinches or more, e.g., ranging up to about 750–1500 microinches, with no low spots of less than about 200 microinches. Advantageously, for best avoidance of surface smoothness, the surface will be free from low spots that are less than about 210 to 220 microinches. It is preferable that the surface have an average roughness of from about 300 to about 500 microinches. Advantageously, the surface has an average number of peaks per inch of at least about 60, but which might be on the order of as great as about 130 or more, with an average from about 80 to about 120 being preferred. It is further advantageous for the surface to have an average distance between the maximum peak and the maximum valley (Rz) of at least about 1,000 microinches and to have a maximum peak height (Rm) of at least about 1,000 microinches. All of such foregoing surface characteristics are as measured by a profilometer. More desirably, the surface for coating will have an Rm value of at least about 1,500 microinches to about 3500 microinches and have a Rz characteristic of at least about 1,500 microinches up to about 3500 microinches.

As representative of the electrochemically active coatings that may then be applied to the etched surface of the metal, are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or organic solvent based, e.g., using alcohol. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings in addition to those enumerated above include manganese dioxide, lead dioxide, platinate coatings such as $M_xPt_3O_4$ where M is an alkali metal and X is typically targeted at approximately 0.5, nickel—nickel oxide and nickel plus lanthanide oxides.

It is contemplated that coatings will be applied to the metal by any of those means which are useful for applying a liquid coating composition to a metal substrate. Such methods include dip spin and dip drain techniques, brush application, roller coating and spray application such as electrostatic spray. Moreover spray application and combination techniques, e.g., dip drain with spray application can be utilized. With the above-mentioned coating compositions for providing an electrochemically active coating, a modified dip drain operation can be most serviceable. Following any of the foregoing coating procedures, upon removal from the liquid coating composition, the coated metal surface may simply dip drain or be subjected to other post coating technique such as forced air drying.

Typical curing conditions for electrocatalytic coatings can include cure temperatures of from about 300° C. up to about 600° C. Curing times may vary from only a few minutes for each coating layer up to an hour or more, e.g., a longer cure time after several coating layers have been applied. However, cure procedures duplicating annealing conditions of elevated temperature plus prolonged exposure to such elevated temperature, are generally avoided for economy of operation. In general, the curing technique employed can be any of those that may be used for curing a coating on a metal substrate. Thus, oven curing, including conveyor ovens may be utilized. Moreover, infrared cure techniques can be useful. Preferably for most economical curing, oven curing is used and the cure temperature used for electrocatalytic coatings will be within the range of from about 450° C. to about 550° C. At such temperatures, curing times of only a few minutes, e.g., from about 3 to 10 minutes, will most always be used for each applied coating layer.

The following examples show ways in which the invention has been practiced, as well as showing comparative examples. However, the examples showing ways in which the invention has been practiced should not be construed as limiting the invention.

EXAMPLE 1

There is used a titanium plate measuring 2 inches by 6 inches by ⅜ inch and being an unalloyed grade 1 titanium, as determined in accordance with the specifications of ASTM B 265-79. This titanium sheet thus contained 0.20 percent, maximum, iron impurity.

This plate, which was a fresh grade 1 titanium plate, was degreased in perchloroethylene vapors, rinsed with deionized water and air dried. It was then etched for approximately 1 hour by immersion in 20 weight percent hydrochloric acid aqueous solution heated to 95° C. After removal from the hot hydrochloric acid, the plate was again rinsed with deionized water and air dried. By this etching, the plate achieves a weight loss of 500–600 grams per square meter of plate surface area. This weight loss is determined by pre and post etching weighing of the plate sample and then calculating the loss per square meter by straight forward calculation on the basis of the surface area of both large flat faces of the plate.

The surface structure of the sample plate, on both broad surfaces, is then examined under a stereo microscope under magnification varying during the study from 40× to 60×. Such plate surface can be seen to have a well defined, three dimensional, grain boundary etch.

The etched surface was then subjected to surface profilometer measurement using a Hommel model T1000 C instrument manufactured by Hommelwerk GmbH. The plate surface profilometer measurements as average values computed from eight separate measurements conducted by running the instrument in random orientation across on large flat face of the plate. This gave average values for surface roughness (Ra) of 393 microinches, peaks per inch (Nr) of 86 and an average distance between the maximum peak and the maximum valley (Rz) of 2104. The peaks per inch were measured within the threshold limits of 300 microinches (lower) and 400 microinches (upper).

COMPARATIVE EXAMPLE 2

A titanium plate sample of unalloyed grade 1 titanium, but from a different batch than the plate sample of Example 1, was etched under the identical conditions of Example 1. Visually, the resulting etched surfaces of the titanium plate sample, as viewed in the manner of Example 1, were found not to have a well defined grain boundary etch. Subsequent profilometer measurements, conducted in the manner of Example 1, provided average values of 157 (Ra), 31 (Nr) and 931 (Rz). Because of the lack of well defined grains as determined visually, plus the lack of a well defined, three dimensional grain boundary etch as determined by profilometer measurement, this plate sample was a comparative sample.

EXAMPLE 2

A second sample plate from the same batch of unalloyed titanium as was used for the plate sample of Comparative Example 2, was subjected to annealing operation. In this operation, the sample was placed in an oven and the oven was heated until the air temperature reached 700° C. This air temperature was then held for 15 minutes, cooled to 450° C., and held for 30 minutes. Thereafter, while the sample was maintained in the oven, the oven air temperature was permitted to cool to about 200° C. in a period of 1.5 hours. The sample was then removed for cooling to room temperature.

The resulting test sample was then etched in boiling 18 weight percent HCl for one hour, then rinsed and dried as described in Example 1. Subsequently, under visual examination in the manner of Example 1, the etched sample plate was seen to have a highly desirable, three dimensional grain boundary etch. This was confirmed by profilometer measurements which provided average values of 398 (Ra), 76 (Nr) and 2040 (Rz).

EXAMPLE 3

A grade 1 titanium plate sample was prepared in the manner of Example 1, except that the etching was for 2 hours in boiling 18 weight percent hydrochloric acid aqueous solution. The sample had a highly desirable three dimensional and well defined grain boundary etching as confirmed by profilometer measurement which provided average values of 343 (Ra) and 63 (Nr). This example was provided with an electrochemically active coating of tantalum oxide and iridium oxide and using an aqueous, acidic solution of chloride salts, the coating being applied and baked in the manner as described in Example 1 of U.S. Pat. No. 4,797,182.

The resulting sample was tested as an anode in an electrolyte that was a mixture of 285 grams per liter (g/l) of sodium sulfate and 60 g/l of magnesium sulfate. The test cell was maintained at 65° C. and operated at a current density of 15 kiloamps per square meter ($kA/m^2$). Periodically the electrolysis was briefly interrupted. The coated titanium plate anode was removed from the electrolyte, rinsed in deionized water, air dried and then cooled to ambient temperature. There was then applied to the coated plate surface, by firmly manually pressing onto the coating, a strip of self-adhesive, pressure sensitive tape. This tape was then removed from the surface by quickly pulling the tape away from the plate.

The coating remained well-adhered throughout the test, with the anode ultimately failing by anode passivation with the coating still predominantly intact at 1223 hours.

COMPARATIVE EXAMPLE 3

A sample of titanium which had been previously coated with an electrochemically active coating, was blasted with alumina powder to remove the previous coating. By this abrasive method, it was determined by X-ray fluoroescence that the previous coating had been removed. After removal of any residue of the abrasive treatment, the resulting sample plate was etched in the composition of Example 1. Under visual inspection as described in Example 1, it was seen that there was no evidence of desirable grain boundary etching. Furthermore, under profilometer measurement, the resulting average values were found to be 189 (Ra) and 25 (Nr).

The sample was nevertheless coated with the electrocatalytic coating of Example 3 in the manner as described in Example 3 and utilized as an anode also in the manner as described in Example 3. After 114 hours of operation, the sample was removed and the coating adhesion tested utilizing the tape test of Example 3. In this test, and after only the 114 hours of testing, the tape test showed the coating to no longer be uniformly well-adhered, with the test removing coating and exposing the underlying substrate and, thus, terminating further testing.

We claim:

1. The method of preparing an electrode having a coating adhered to a metal substrate surface of an impure metal that has enhanced adhesion for said coating on said surface, which method consists essentially of:

subjecting said metal substrate surface to air, vacuum or inert gas elevated temperature annealing at a temperature within the range from at least about 500° C. to about 800° C. for a time from about 15 minutes to four hours to provide intergranular impurities in said metal, including intergranular impurities at said surface of said metal;

cooling the resulting annealed surface;

etching intergranularly said surface at an elevated temperature and with a strong acid or strong caustic etchant to an average roughened surface of at least about 250 microinches and an average surface peaks per inch of at least about 40, both as measured by profilometer with said peaks per inch being basis a lower profilometer threshold limit of 300 microinches and an upper profilometer threshold limit of 400 microinches;

while maintaining said surface at least substantially free from deleterious effects of mechanical surface treatment; and coating said surface following intergranular etching.

2. The method of claim 1, wherein said cooling includes quenching.

3. The method of claim 1, wherein said annealing provides an at least substantially continuous intergranular network of impurities.

4. The method of claim 3, wherein said etching attacks an at least substantially continuous intergranular network of diffuse impurities.

5. The method of recoating a coated metal electrode, which method consists essentially of:

subjecting a coated metal electrode surface to a melt containing basic material for removing said coating;

separating said metal surface from said melt, cooling same and removing melt residue therefrom;

subjecting said surface to air, vacuum or inert gas elevated temperature annealing at a temperature within the range from at least about 500° C. to 800° C. for a time from about 15 minutes to four hours, to provide intergranular surface impurities for said metal;

cooling the resulting annealed surface;

etching intergranularly said surface at an elevated temperature and with a strong acid or strong caustic etchant to an average roughened surface of at least about 250 microinches and an average surface peaks per inch of at least about 40, both as measured by profilometer with said peaks per inch being basis a lower profilometer threshold limit of 300 microinches and an upper profilometer threshold limit of 400 microinches;

while maintaining said surface at least substantially free from deleterious effects of mechanical surface treatment; and coating said surface following intergranular etching.

6. The method of claim 5, wherein said annealing provides an at least substantially continuous intergranular network of impurities.

7. The method of claim 6, wherein said etching attacks said at least substantially continuous, intergranular network of impurities.

* * * * *

UNITED STATES PATENT AND TRADEMARK OFFICE

CERTIFICATE OF CORRECTION

PATENT NO. : 5,545,262

DATED : August 13, 1996

INVENTOR(S) : K. L. Hardee et al

It is certified that error appears in the above-identified patent and that said Letters Patent is hereby corrected as shown below:

Column 8, line 61, after "surface to" insert --an annealing consisting of--.

Column 10, line 1, after "surface to" insert --an annealing consisting of--.

Signed and Sealed this

Nineteenth Day of November, 1996

*Attest:*

*Attesting Officer*

BRUCE LEHMAN

*Commissioner of Patents and Trademarks*